US005649857A

United States Patent [19]

Suhrheinrich et al.

[11] Patent Number: 5,649,857

[45] Date of Patent: Jul. 22, 1997

[54] ABRASIVE WHEEL

[75] Inventors: Rolf Suhrheinrich, Marienheide; Hermann Hardenbicker, Wipperfürth; Norbert Klein, Kierspe, all of Germany

[73] Assignee: August Rüggeberg, Marienheide, Germany

[21] Appl. No.: 524,688

[22] Filed: Sep. 7, 1995

[30] Foreign Application Priority Data

Sep. 9, 1994 [DE] Germany ..... 44 32 168.6

[51] Int. Cl.[6] ..... B24B 9/02

[52] U.S. Cl. ..... 451/466; 451/469; 451/490

[58] Field of Search ..... 451/490, 496, 451/497, 498, 502, 503, 466, 467, 468, 469

[56] References Cited

U.S. PATENT DOCUMENTS

| | | | |
|---|---|---|---|
| 2,581,411 | 1/1952 | Hendrickson . | |
| 2,871,632 | 2/1959 | Cosmos | 451/469 |
| 3,099,113 | 7/1963 | Jeske | 451/466 |
| 3,200,543 | 8/1965 | O'neil, Jr. et al. | 451/469 |
| 3,600,861 | 8/1971 | Haywood . | |
| 3,747,285 | 7/1973 | Block | 451/490 |
| 4,004,316 | 1/1977 | Ali . | |
| 4,275,529 | 6/1981 | Teetzel et al. | 451/466 |
| 4,612,738 | 9/1986 | Pittinger, Sr. et al. | 451/467 |
| 4,872,292 | 10/1989 | Block | 451/466 |
| 4,969,299 | 11/1990 | Block . | |
| 5,284,039 | 2/1994 | Torgerson | 451/466 |

FOREIGN PATENT DOCUMENTS

| | | | |
|---|---|---|---|
| 517 150 | 1/1931 | Germany . | |
| 19 27 096 | 7/1965 | Germany . | |
| 25 01 589 | 1/1975 | Germany . | |
| 31 45 151 C2 | 11/1981 | Germany . | |
| 003112773 | 10/1982 | Germany | 451/490 |
| 3140012 | 4/1983 | Germany . | |

OTHER PUBLICATIONS

Excerpt from sales catalog from 3M Industrial Abrasives.
Excerpt from sales catalog from Merit Abrasives.

*Primary Examiner*—James G. Smith
*Assistant Examiner*—Dona C. Edwards
*Attorney, Agent, or Firm*—Browdy and Neimark

[57] ABSTRACT

A laminated abrasive wheel comprises a central carrying member having two holding flanges between which abrasive laminae assembled to form stacks of abrasive laminae are arranged. On the holding flanges there are fastened respectively alternating studs which are pushed between the stacks of abrasive laminae and which serve to hold them under friction. At the same time, the holding flanges are also connected to the stacks of abrasive laminae to form a unit.

19 Claims, 2 Drawing Sheets

ABRASIVE WHEEL

FIELD OF THE INVENTION

This invention relates to laminated abrasive wheels.

BACKGROUND OF THE INVENTION

Conventional laminated abrasive wheels also known in practice as fan wheels have a carrying member which consists essentially of two lid-like holding flanges. Between these holding flanges there are uniformly distributed over the periphery abrasive laminae which are generally arranged radially to the central longitudinal axis but which can also be set at an angle thereto. The abrasive laminae usually consist of a carrier material, for example a woven fabric or a paper-like substance. Abrasive material, that is abrasive grain, is arranged on one surface of the carrier material. The abrasive laminae are connected to the carrying member by adhesion in their foot region adjacent to the central longitudinal axis and located between the holding flanges. Two-component adhesive which is generally epoxide adhesive consisting of resin and hardener is used for this purpose in practice. The carrying member remaining after wear with the foot region of the abrasive laminae and the adhesive is a block which can only be disposed of with difficulty.

It is also known to provide roll-shaped carrying members with undercut grooves extending parallel to their axis on their external surface, into which grooves lamina carrying plates provided with an enlarged strip-like foot can be inserted. Stacks of abrasive laminae which also project outwardly in the manner of segments are fastened on these lamina carrying plates by means of staples or the like. Flange rings which prevent the lamina carrying plates from slipping out of the grooves are arranged on the end faces. The stacks of abrasive laminae can be renewed after wearing of the abrasive laminae. The hubs are therefore reusable. The remains of the abrasive laminae and the laminae carrying plates can easily be disposed of. Laminated abrasive wheels of this type made by 3M and Merit Abrasives are known.

SUMMARY OF THE INVENTION

The object of the invention is to design a laminated abrasive wheel of the generic type in such a way that it can be produced at low cost.

Accordingly the present invention provides a laminated abrasive wheel comprising a central carrying member, having two holding flanges arranged parallel to one another and concentrically to a common central longitudinal axis, mechanical clamping means and a plurality of leaf-shaped abrasive laminae which are arranged between the holding flanges, each said leaf-shaped abrasive lamina having an abrasive portion projecting outwardly beyond the holding flanges and a foot region located between the holding flanges; wherein a number of said laminae are combined to form a plurality of stacks which are distributed with mutual spacing around said carrying member and wherein the abrasive laminae of each stack are pressed together in their foot regions by said mechanical clamping means and are connected to the carrying member by the said clamping means.

As the laminated abrasive wheel is produced without adhesion, the tool remaining after abrasion can easily be disposed of and does not pollute the environment as it can easily be broken down into its basic components. Furthermore, the number of laminae is reduced in comparison with conventional laminated abrasive wheels, i.e. the use of abrasive material is reduced. It follows from the segmenting resulting from the arrangement of the stacks of abrasive laminae that, despite the slighter use of abrasive laminae, the wear of laminae is less than with conventional laminated abrasive wheels. As the abrasive laminae are pressed together in their foot region, the stacks of abrasive laminae also become stiffer in their abrasive region projecting outwardly beyond the carrying member. This leads to greater removal of material from the workpiece to be abraded and to reduced abrasion times. The behaviour in use and the behaviour in abrasion of the laminated abrasive wheel according to the invention is almost the same as in conventional laminated abrasive wheels. Production can be carried out in a particularly simple manner with low construction costs. Preferably, the clamping means comprise a plurality of studs which are arranged between respective mutually adjacent stacks of abrasive laminae and are connected to the carrying member.

The studs are desirably connected to at least one of the holding flanges and may be arranged at equal angular intervals. The studs may also have tapered free ends.

According to a preferred embodiment, each second respective stud is connected to one holding flange and each other second stud is connected to the other holding flange. In other words, alternate studs are connected to alternate holding flanges.

It is also preferred that each holding flange be provided with a series of recesses and that each stud should have a free end which engages in a respective recess in a holding flange.

According to another embodiment of the invention, between the two respective adjacent stacks of abrasive laminae there are arranged two mutually aligned studs of which each one is connected to a respective one of the holding flanges.

The studs may be provided with clamping faces which rest flat on the foot regions of the stacks of abrasive laminae.

The stacks of abrasive laminae and the studs are desirably held together between the holding flanges of the carrying member by friction.

Preferably, the abrasive laminae are arranged substantially parallel to one another in the stacks of abrasive laminae.

Each holding flange is desirably provided with a plurality of projections and each of the abrasive laminae desirably has, on at least one longitudinal side, a recess in which a respective projection on a holding flange engages.

BRIEF DESCRIPTION OF THE DRAWINGS

The invention will now be described in detail, by way of example, with reference to the drawings, in which.

DESCRIPTION OF THE PREFERRED EMBODIMENTS

Figure 1:
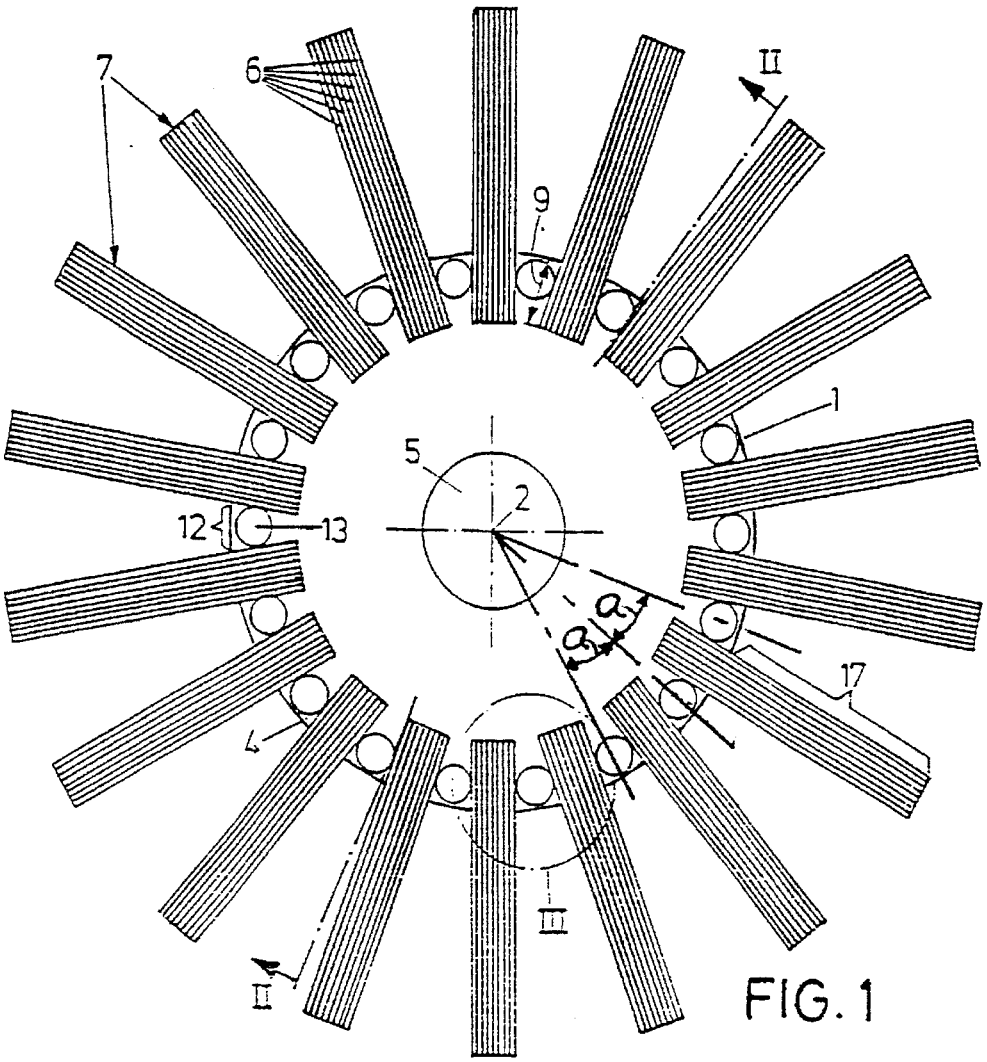
FIG. 1 is plan view of one embodiment of a laminated abrasive wheel according to the invention with the upper holding flange removed.
Figure 3:
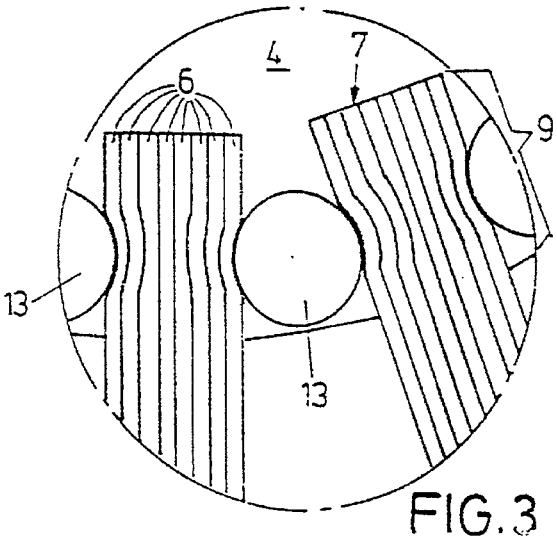
FIG. 3 shows a detail III from FIG. 1 on an enlarged scale.
Figure 2:
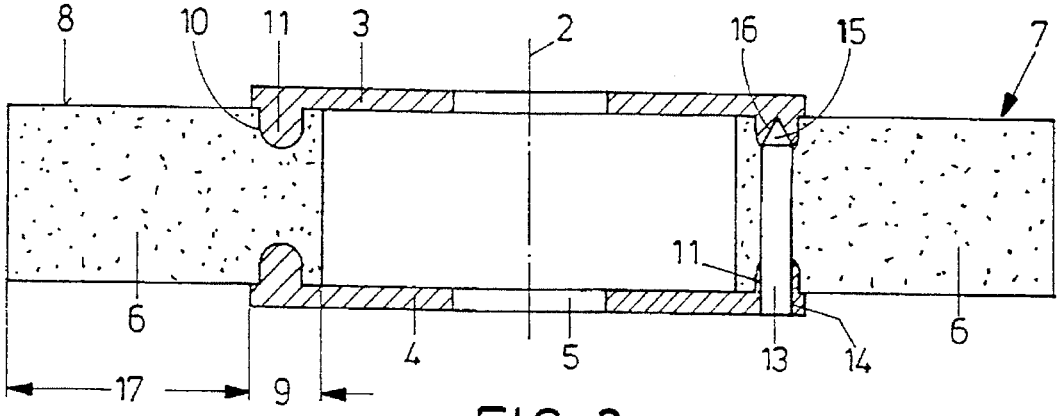
FIG. 2 is a cross-section through the laminated abrasive wheel shown in FIG. 1 along section line II—II in the direction of the arrows.

The laminated abrasive wheel shown in FIGS. 1 to 3 has a central carrying member 1 having two lid-like holding flanges 3, 4 produced from metal sheet and arranged in parallel and concentrically to a common central longitudinal axis 2. The carrying member 1 has a receiving orifice 5 for the spindle of a grinding machine.

Leaf-shaped abrasive laminae 6 which are generally cut substantially rectangularly and usually consist of a flexible carrier material such as fabric or paper with abrasive grain arranged thereon are combined to form cuboid stacks 7 of abrasive laminae. As shown in FIG. 2, they have a respective recess 10 on their longitudinal sides 8, more specifically in the foot region 9. On the holding flanges 3, 4 there are formed projections 11 which are adapted to the recesses 10 and, when the stacks 7 of abrasive laminae are arranged between the holding flanges 3, 4, engage in the recesses 10.

If the stacks 7 of abrasive laminae are each arranged with mutual spacing on a holding flange 3, 4 or between the holding flanges 3, 4, spaces 12 remain between adjacent stacks 7 of abrasive laminae. In these spaces 12 between adjacent foot regions 9 of adjacent stacks 7 of abrasive laminae there are arranged as clamping devices studs 13 which are fastened in respective adapted orifices 14 in the holding flange 4 or 3 and are laterally secured and centered with their other respectively tapered free end 15 in an adapted recess 16 on the opposite holding flange 3 or 4, bending of the studs additionally also being prevented. The abrasive laminae 6 of a stack 7 of abrasive laminae are pressed against one another perpendicularly to the main plane of the abrasive laminae 6 in the foot region 9 by respective mutually adjacent studs 13 so firmly that they are held firmly on the carrying member 1. The clamping forces are sufficiently great for the connection between stacks 7 of abrasive laminae and carrying members 1 to be sufficiently rigid even against the centrifugal forces occurring during abrasion and the abrasive forces acting on the radially outer abrasive portions 17.

The laminated abrasive wheel is fitted in such a way that each holding flange 3, 4 is provided with half the respective studs 13 which are arranged at equal angular intervals a as shown in FIG. 1. In the present embodiment, each holding flange 3 or 4 is provided with nine studs 13 which are each arranged with spacing of 40°. The eighteen stacks 7 of abrasive laminae are placed on the lower holding flange 3 in such a way that they each rest with their foot region 9 against a stud 13 arranged on the lower holding flange 4 at one end. The upper holding flange 3 is then applied with studs 13 which are offset by half the angle between two studs, that is offset by 20° relative to the lower holding flange 4, wherein the studs can be shifted between two mutually adjacent foot regions 9 of two stacks 7 of abrasive laminae owing to the taper of the end 15. The stacks 7 of abrasive laminae are held in the described manner by being pressed together, that is by friction. Similarly, the studs 13 are clamped between the stacks 7 of abrasive laminae. Owing to the simple pressing together of the two holding flanges 3, 4 in the described manner, the holding flanges are also held relative to one another and to the stacks 7 of abrasive laminae. The carrying member 1 is therefore also held together merely by friction. The tapered ends 15 of the studs 13 engage in the recesses 16 so they are on the one hand centered and on the other hand laterally secured. The carrying member 1 formed by the two holding flanges 3, 4 and the studs 13 is therefore rigid in itself, more specifically against displacement of the holding flanges 3, 4 transversely to the axis 2, i.e. in their own main plane. The projections 11 engage in the recesses 10, producing additional security against centrifugal forces.

Figure 4:
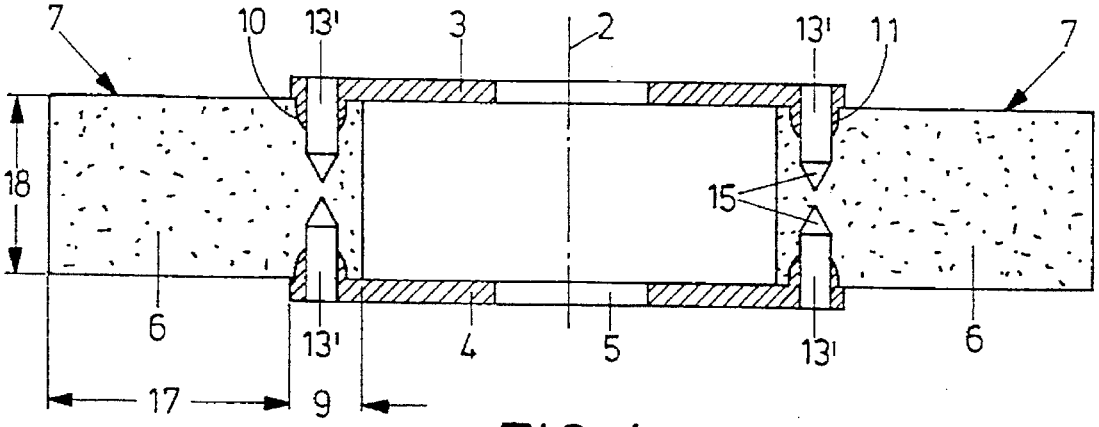
FIG. 4 is a cross-section through a laminated abrasive wheel with a modified form of carrying member.

The embodiment shown in FIG. 4 differs from the embodiment shown in FIGS. 1 to 3 only with respect to the design of the studs 13'. FIGS. 1 and 3 also apply, in particular, to this embodiment. The same reference numerals are used where there is conformity without the need for a new description. The studs 13' are arranged on the two holding flanges 3, 4 between two respective adjacent stacks 7 of abrasive laminae. With their tapered end 15, they are not therefore secured in a recess in the respectively opposed holding flange 3 or 4 but are aligned with one another in each case. As the holding flanges 3, 4 are also held by the clamping of the studs 13 between the stacks 7 of abrasive laminae, holding flanges 3, 4 with the short studs 13' can be used to make up laminated abrasive wheels with different dimensions 18 of the abrasive laminae 6 in the direction of the axis 2. In the present embodiment, therefore, each holding flange 3 and 4 is provided with 18 studs 13'. In all embodiments, the holding flanges 3 and 4 can obviously be designed integrally with the studs 13 and 13', for example by injection moulding or light metal diecasting.

Figure 5:
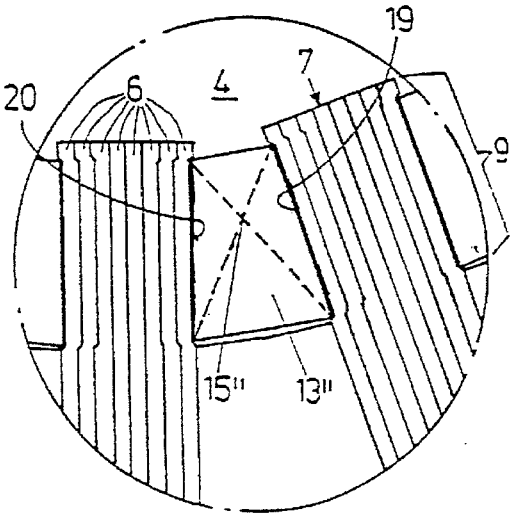
FIG. 5 is a view corresponding to FIG. 3 but showing a modified embodiment of a stud.

FIG. 5 shows a modified stud 13" which is substantially trapezoidal in design and has two clamping faces 19, 20 which extend substantially radially to the central longitudinal axis 2, extend over the complete foot region 9 of the abrasive laminae 6 and thus exert a greater clamping effect than the cylindrical studs 13 and 13'. The design is otherwise as described hereinbefore, i.e. the studs 13" can be arranged as shown in FIG. 4 or as shown in FIG. 2. They can also have a tapered free end 15".

If the abrasive portions 17 are worn and the laminated abrasive wheel is to be disposed of, the carrying member 1 or 1' can be opened with the foot regions 9 of the stacks 7 of abrasive laminae still located therein by pressing the two holding flanges 3, 4 apart, and the holding flanges 3, 4 generally consisting of identical material with studs 13 or 13' or 13" on the one hand and the foot regions 9 of the abrasive laminae 6 then fall apart.

The invention is not restricted to the above-described embodiments but variations and modifications may be made without departing from the spirit and scope of the invention as defined by the appended claims.

I claim:

1. An abrasion wheel comprising a central carrying member, having two holding flanges arranged parallel to one another and concentrically to a common central longitudinal axis, clamping means and a plurality of leaf-shaped abrasive laminae which are arranged between the holding flanges, each said leaf-shaped abrasive lamina having an abrasive portion projecting outwardly beyond the holding flanges and a foot region located between the holding flanges; wherein a number of said laminae are combined to form a plurality of stacks which are distributed with mutual spacing around said carrying member and wherein the abrasive laminae of each stack are pressed together in their foot regions by said clamping means and are connected to the carrying member by the said clamping means, wherein the clamping means comprise a plurality of studs which are arranged between respective mutually adjacent stacks of abrasive laminae and are connected to the carrying member, wherein first alternate studs of said plurality of studs are connected to a first holding flange of said two holding flanges and second alternate studs of said plurality of studs are connected to a second holding flange of said two holding flanges.

2. The abrasion wheel as claimed in claim 1, in which the studs are arranged at equal angular intervals.

3. The abrasion wheel as claimed in claim 1, in which each of the studs has a tapered free end.

4. The abrasion wheel as claimed in claim 1, in which each holding flange of said two holding flanges is provided with a series of recesses and in which each stud has a free end which engages in a respective recess in a holding flange of said two holding flanges.

5. The abrasion wheel as claimed in claim 1, in which the studs have clamping faces resting flat on the foot regions of the stacks of abrasive laminae.

6. The abrasion wheel as claimed in claim 1, in which the stacks of abrasive laminae are held together between adjacent studs of said plurality of studs by friction and the plurality of studs are held together between the two holding flanges of the carrying member by friction.

7. The abrasion wheel as claimed in claim 1, in which the abrasive laminae are arranged substantially parallel to one another in the stacks of abrasive laminae.

8. The abrasion wheel as claimed in claim 1, in which each holding flange of the two holding flanges is provided with a plurality of projections and in which each of the abrasive laminae has, on at least one longitudinal side, a recess in which a respective projection on a holding flange engages.

9. A laminated abrasive wheel comprising a central carrying member, having two holding flanges arranged parallel to one another and concentrically to a common central longitudinal axis, clamping means and a plurality of leaf-shaped abrasive laminae which are arranged between the holding flanges, each said leaf-shaped abrasive lamina having an abrasive portion projecting outwardly beyond the holding flanges and a foot region located between the holding flanges; wherein a number of said laminae are combine to form a plurality of stacks which are distributed with mutual spacing around said carrying member and wherein the abrasive laminae of each stack are pressed together in their foot regions by said clamping means and are connected to the carrying member by the said clamping means, wherein the clamping means comprise a plurality of studs which are arranged between respective mutually adjacent stacks of abrasive laminae and are connected to the carrying member, wherein between two respective adjacent stacks of abrasive laminae there are arranged two mutually aligned studs of which each one is connected to a respective one of the holding flanges.

10. The abrasion wheel as claimed in claim 9, in which the studs are arranged at equal angular intervals.

11. The abrasion wheel as claimed in claim 9, in which each of the studs has a taper free end.

12. The abrasion wheel as claimed in claim 9, in which the studs have clamping faces resting flat on the foot regions of the stacks of abrasive laminae.

13. The abrasion wheel as claimed in claim 9, in which the stacks of abrasive laminae are held together between adjacent studs of said plurality of studs by friction and the plurality of studs are held together between the holding flanges of the carrying member by friction.

14. The abrasion wheel as claimed in claim 9, in which the abrasive laminae are arranged substantially parallel to one another in the stacks of the abrasive laminae.

15. The abrasion wheel as claimed in claim 9, in which each holding flange is provided with a plurality of projections and in which each of the abrasive laminae has, on at least one longitudinal side, a recess in which a respective projection on a holding flange engages.

16. The abrasion wheel comprising a central carrying member, having two holding flanges arranged parallel to one another and concentrically to a common central longitudinal axis, clamping means and a plurality of leaf-shaped abrasive laminae which are arranged between the holding flanges, each said leaf-shaped abrasive lamina having an abrasive portion projecting outwardly beyond the holding flanges and a foot region located between the holding flanges; wherein a number of said laminae are combined to form a plurality of stacks which are distributed with mutual spacing around said carrying member and wherein the abrasive laminae of each stack are pressed together in their foot regions by said clamping means and are connected to the carrying member by the said clamping means, wherein the clamping means comprise a plurality of studs which are arranged between respective mutually adjacent stacks of abrasive laminae and are connected to the carrying member, wherein the stacks of abrasive laminae are held together between adjacent studs of said plurality of studs by friction and the plurality of studs are held together between the holding flanges of the carrying member by friction, and in which each of the studs has a tapered free end.

17. The abrasion wheel as claimed in claim 16, wherein first alternate studs of said plurality of studs are connected to a first holding flange of said two holding flanges and second alternate studs of said plurality of studs are connected to a second holding flange of said two holding flanges.

18. The abrasion wheel as claimed in claim 16, in which the studs have clamping faces resting flat on the foot regions of the stacks of abrasive laminae.

19. The abrasion wheel as claimed in claim 16, in which each holding flange is provided with a plurality of projections and in which each of the abrasive laminae has, on at least one longitudinal side, a recess in which a respective projection on a holding flange engages.

* * * * *